US009895577B2

(12) United States Patent
Montgomery

(10) Patent No.: US 9,895,577 B2
(45) Date of Patent: Feb. 20, 2018

(54) KNEE REHABILITATION ASSISTANCE DEVICE

(71) Applicant: Ryan J. Montgomery, Salyersville, KY (US)

(72) Inventor: Ryan J. Montgomery, Salyersville, KY (US)

( * ) Notice: Subject to any disclaimer, the term of this patent is extended or adjusted under 35 U.S.C. 154(b) by 0 days.

(21) Appl. No.: 15/375,154

(22) Filed: Dec. 11, 2016

(65) Prior Publication Data

US 2017/0189748 A1 Jul. 6, 2017

Related U.S. Application Data

(63) Continuation of application No. 14/179,370, filed on Feb. 12, 2014, now Pat. No. 9,517,380.

(60) Provisional application No. 61/763,831, filed on Feb. 12, 2013.

(51) Int. Cl.

| | |
|---|---|
| ***A63B 23/035*** | (2006.01) |
| ***A63B 23/04*** | (2006.01) |
| ***A63B 21/00*** | (2006.01) |
| ***A63B 21/22*** | (2006.01) |
| ***A63B 21/055*** | (2006.01) |

(52) U.S. Cl.

CPC ..... *A63B 23/0494* (2013.01); *A63B 21/0552* (2013.01); *A63B 21/154* (2013.01); *A63B 21/22* (2013.01); *A63B 21/4013* (2015.10); *A63B 21/4035* (2015.10); *A63B 2208/0252* (2013.01); *A63B 2225/093* (2013.01)

(58) Field of Classification Search

CPC ..... A63B 23/0494; A63B 23/03508; A63B 23/0417; A63B 23/0482; A63B 23/0294; A63B 23/08; A63B 23/10; A63B 23/203; A61H 1/0237; A61H 1/024; A61H 1/0244; A61H 1/0255; A61H 1/0266; A61H 1/0259; A61H 2201/164; A61H 2201/1642

See application file for complete search history.

(56) References Cited

U.S. PATENT DOCUMENTS

| | | | | |
|---|---|---|---|---|
| 1,089,801 | A * | 3/1914 | Swanson | 602/15 |
| 3,717,144 | A | 2/1973 | Bimler | |
| 4,492,222 | A * | 1/1985 | Hajianpour | 601/33 |
| 4,784,121 | A | 11/1988 | Brooks | |

(Continued)

*Primary Examiner* — Sundhara Ganesan
*Assistant Examiner* — Rae Fischer
(74) *Attorney, Agent, or Firm* — Brian W. Foxworthy; Robert R. Waters; Waters Law Group, PLLC

(57) ABSTRACT

A device for exercising leg muscles, ligaments, and tendons attendant to movement of a human knee following knee replacement surgery or during rehabilitation following knee injury is provided. The user lies supine on a flat surface and braces the back of his or her upper thigh against the device's leg support bar, so that the user's upper thigh is approximately perpendicular to the user's upper torso. The patient maintains this position and exercises the knee by extending and flexing his or her lower leg. Some embodiments include an elastic band that attaches to the device in a position that limits the degree of leg flexion to within a desired range. Some embodiments include an ankle strap attached to a cord, which may be used to build quadriceps strength through application of resistance, and/or for applying downward pulling force to the lower leg during passive range-of-motion exercising.

14 Claims, 10 Drawing Sheets

(56) References Cited

U.S. PATENT DOCUMENTS

| | | | | | |
|---|---|---|---|---|---|
| 4,844,454 | A | | 7/1989 | Rogers | |
| 4,922,892 | A | | 5/1990 | Akcelrod et al. | |
| 5,067,709 | A | | 11/1991 | Christianson | |
| 5,074,549 | A | | 12/1991 | Harvey | |
| 5,236,333 | A | | 8/1993 | Barba, Jr. | |
| 5,253,639 | A | * | 10/1993 | Johnston | 601/34 |
| 5,277,680 | A | | 1/1994 | Johnston | |
| 5,286,242 | A | | 2/1994 | Johnston | |
| 5,324,245 | A | | 6/1994 | Fontana et al. | |
| 5,509,894 | A | | 4/1996 | Mason et al. | |
| 5,582,579 | A | | 12/1996 | Chism et al. | |
| 5,647,823 | A | | 7/1997 | Spence | |
| 5,820,519 | A | | 10/1998 | Slenker | |
| 6,962,570 | B2 | | 11/2005 | Callanan et al. | |
| 7,244,238 | B2 | | 7/2007 | March et al. | |
| 7,476,187 | B2 | | 1/2009 | Corte | |
| 7,534,213 | B2 | | 5/2009 | Shelbourne et al. | |
| 8,376,918 | B2 | | 2/2013 | Itzkowitz | |
| 8,591,385 | B2 | | 11/2013 | Wang | |
| 2003/0144090 | A1 | * | 7/2003 | Belik | 473/473 |
| 2005/0277527 | A1 | | 12/2005 | Gregerson | |
| 2007/0010375 | A1 | * | 1/2007 | Corte | 482/41 |

* cited by examiner

KNEE REHABILITATION ASSISTANCE DEVICE

CROSS REFERENCE TO RELATED APPLICATIONS

This application is a continuation application of U.S. patent application Ser. No. 14/179,370 filed on Feb. 12, 2014. U.S. patent application Ser. No. 14/179,370 claims priority to U.S. Provisional Application 61/763,831, filed on Feb. 12, 2013. The entire disclosures contained in U.S. Provisional Application 61/763,831 and U.S. patent application Ser. No. 14/179,370 including the attachments thereto, are incorporated herein by reference.

FIELD OF THE INVENTION

The present application is generally related to devices with which a person may rehabilitate muscles and ligaments attendant to extending and flexing of the knee joint. More specifically, the present application relates generally to devices with which a person may undertake therapeutic exercise for rehabilitation, following knee replacement, knee surgery, or knee injury.

BACKGROUND OF THE INVENTION

Axiomatic in the field of physical therapy is that early implementation of a rehabilitation program, comprised of motion and strengthening exercises, is essential to realizing optimal results for regaining functional recovery following surgery or injury to the knee joint.

For patients who have undergone surgery for knee replacement or repair, medical care professionals will routinely recommend protocols designed to enable the patient to control and manage pain and swelling, increase range of motion, and endure progressive weight-bearing, in accordance with the patient's strength level, healing progress, and pain tolerance. Many traditional knee rehabilitation exercises involve hands-on manipulation by a physical therapist, as well as exercises performed by the patient without the assistance of mechanical devices or other individuals.

The object of the present device is, generally, to provide an apparatus to facilitate the attainment of rehabilitation goals for patients or users recovering from knee repair or replacement surgery, by providing an easily portable knee exercise device with which the patient or user, while lying comfortably on a floor or other flat, horizontal surface, can position and maintain his or her leg in an approximately vertical position relative to the user's upper torso in order to situate the targeted knee above the user's heart to alleviate knee swelling; and, which the user may use when he or she is at a rehabilitation phase that is centered primarily on passive range of motion and management of swelling, as well as when the user progresses to a stage in the rehabilitation process where he or she may focus more directly on developing strength and functional independence.

RELEVANT ART

There are patented inventions which may be of some use for rehabilitating a knee that has been injured or which has undergone surgery. For example, U.S. Pat. No. 5,074,549 to Harvey discloses a frame structure with a horizontal bar which enables the leg to be flexed such that the leg is approximately vertical. Thereafter, weights or other pressure devices may be used to navigate the lower leg so as to exercise the knee joint. However, Harvey requires the user to grip the device and apply a pulling force on the invention itself, in order for the user to situate his or her upper thigh in certain positions. Also, Harvey does not appear designed for truly passive exercising of the user's knee through extension or flexion.

Another invention known to the inventor is the knee rehabilitation device of Mason et al., U.S. Pat. No. 5,509,894. Mason, et al. involves suspension of the user's leg using a bar, located above the leg, to which straps are attached. The user's leg is strapped just above the knee, and also around the ankle. However, Mason et al. does not place the user's leg in a truly perpendicular position, relative to the surface on which it is placed, and thus is relatively limited in the ranges through which the user may move his or her leg.

An exercise device detailed in expired U.S. Pat. No. 3,717,144 to Bimler describes a device wherein both the upper leg and lower leg are supported by sections which pivot to allow the knee to bend. The upper and lower leg remain supported during movement. The Bimler device appears to allow no more than approximately 90 degrees of bend in the knee during flexion, which may diminish the invention's utility for users who are have progressed to a point in the rehabilitation process of being able to tolerate a fuller range of knee bend.

Another exercise device is U.S. Pat. No. 4,844,454 to Rogers. This device features a hinged platform to which the upper leg and lower leg are strapped. The hinge action of the platform is facilitated by manual manipulation of a handle attached to the platform. The Rogers device appears to work the user's leg from and between an approximately extended leg position, to a leg position where the knee is flexed to approximately 90 degrees. Thus, Rogers provides a relatively limited range of motion during exercise.

A knee exercise device by Brooks is described in U.S. Pat. No. 4,784,121. The user of this device sits on a plate which is placed in a chair. The plate is attached to pivotally mounted levers and linkage whereby the user may manually control resistance when lowering or extending the leg. The knee can be flexed so that the leg is approximately straight. However, like Rogers and Bimler, the range of motion for bending the knee is limited to approximately 90 degrees. Also, the knee is positioned below the user's heart, and thus may have limited utility for the controlling of swelling that may be present in the user's knee.

Therefore, while there are currently inventions which appear to be of use for knee rehabilitation while offering such advantages as being portable, comfortable, safe to use, and easily adaptable for users of all body types, there does not appear to be any one device that offers these advantages while allowing the user to exercise the knee in a position which helps to reduce swelling, while also offering substantial versatility with the degree of range-of-motion and resistance exercising that the user may undertake in accordance with the strength, pain, and tissue-healing constraints with which the user may be coping at various phases of the rehabilitation process.

SUMMARY OF EMBODIMENTS OF THE INVENTION

The embodiment of the present device is comprised of a rehabilitation assistance device for use in strengthening and stretching muscles, tendons, and ligaments attendant to movement of a human knee following surgery for knee repair or replacement, or for rehabilitation of injuries to or around the knee. The device allows the post-operative user to lie down comfortably on a flat, horizontal surface, and brace the leg which is being rehabilitated so that the user's upper thigh is approximately vertical in relation to the user's upper torso.

An embodiment of the present device is comprised of an elongate section of straight, hollow, approximately cylindrical pipe. Attached proximal to both ends of the elongate section of pipe is a section of straight, hollow, approximately cylindrical pipe extending approximately perpendicularly from the elongate section of pipe, to form a "T" shape at both ends of the elongate section of pipe. The "T" sections at either end of the elongate section of pipe are approximately parallel to one another.

An approximately cylindrical cross-piece of pipe is attached at the approximate center part of the elongate section of pipe, so that the central part of the cross-piece intersects the central portion of the elongate section of pipe, and so that the cross-piece is approximately parallel to the sections of pipe that form a "T" shape at either end of the length of pipe. The elongate section of pipe, "T" shape sections of pipe, and cross-piece of pipe are situated approximately horizontal with the flat surface on which the user lies supine when using the device.

Attached proximal to both ends of the cross-piece is a straight section of pipe that attaches proximally to and extends vertically from each end of the cross-piece. Each of these two vertical sections of pipe is approximately perpendicular in relation to the elongate section of pipe, "T" sections of pipe, and cross-piece of pipe. The two vertical sections of pipe are approximately parallel to one another. In some embodiments, a stabilizing bar connects to and spans the distance between each vertical section of pipe, to more firmly maintain the two vertical sections of pipe in a parallel position to one another.

In an embodiment of the present device, the elongate section of pipe, "T" shape sections of pipe, cross-piece of pipe, vertical sections of pipe, and stabilizing bar comprise the framework components of the present device. In some embodiments, the framework components are comprised of polyvinyl chloride (PVC) pipe. In some embodiments, the framework components of the present device may be comprised of any solid, durable, lightweight material.

In some embodiments, the assembled framework components are secured together with one another by angled couplers comprised of light materials similar or identical to the materials of which the framework components are comprised. In some embodiments, the angled couplers are bound to the framework components using appropriate adhesives.

In an embodiment of the present device, a leg support bar made of lightweight metal, PVC pipe, or other durable, lightweight material is attached to a mount located intermediately along the elongate section of pipe. In some embodiments, the mount projects vertically from the elongate section of pipe at a point which is approximately midway between the cross-piece of pipe and one of the sections of pipe that firms a "T" at one end of the length of pipe. When attached, the leg support bar extends upward from the elongate section of pipe. In some embodiments, the mount connects proximally to the lower end of the leg support bar in a manner that forms an axis along which the leg support bar may be selectively adjusted to move clockwise or counterclockwise from approximately zero degrees to approximately one hundred and eighty degrees along a generally vertical plane.

In some embodiments, an arcuate brace is attached proximal to the upper end of the leg support bar, distal to the elongate section of pipe. The user gets into position for using the present device by lying flat on his or her back, against the floor or other flat surface upon which the present device has been placed. The user is properly positioned when he or she is lying nearest to the end of the device where the leg support bar is located, with the upper thigh of the patient's "targeted" leg raised to approximately ninety degrees in relation to the user's upper torso. The back of the user's upper thigh fits within the concavity of the arcuate brace proximal to, but just above, the knee joint. The user's upper thigh is thusly maintained in an approximately vertical position to enable the user to bend and flex the knee in accordance with the user's capabilities and rehabilitation objectives.

In some embodiments of the present device, one or more elastic bands may stretch along an approximately horizontal plane from one vertical section of pipe to the other vertical section of pipe, to serve as a way to limit the range of flexion for the user's leg, in accordance with the user's pain tolerance and/or range of motion capabilities and/or rehabilitation directives. In such embodiments, the vertical sections are telescoping to allow selective adjustment of the height at which the band is positioned relative to the flat surface on which the user is resting. At the selected height, the user's leg makes contact with the band at some point during flexion, thus selectively limiting the user's flexion range of motion.

In some embodiments, the user may fit his or her ankle into an ankle strap that is attached to a rope of nylon or other weather-resistant material. In such embodiments, a pulley system allows the user to do quadriceps strengthening exercising by applying a desired amount of pulling force to a handle attached to the rope at the end opposite of where the ankle strap is attached. This pulling action facilitates upper thigh and knee joint strengthening by exerting reciprocal resistance against extension of the user's leg, and/or provides downward-pulling force to the user's lower leg as may be appropriate where the user has a stiff knee joint in need of passive range-of-motion exercising.

BRIEF DESCRIPTION OF THE DRAWINGS

Additional utility and features of this device will become more fully apparent to those skilled in the art by reference to the following drawings, which illustrate some of the primary features of preferred embodiments.

DETAILED DESCRIPTION OF EMBODIMENTS OF THE INVENTION

Figure 1:
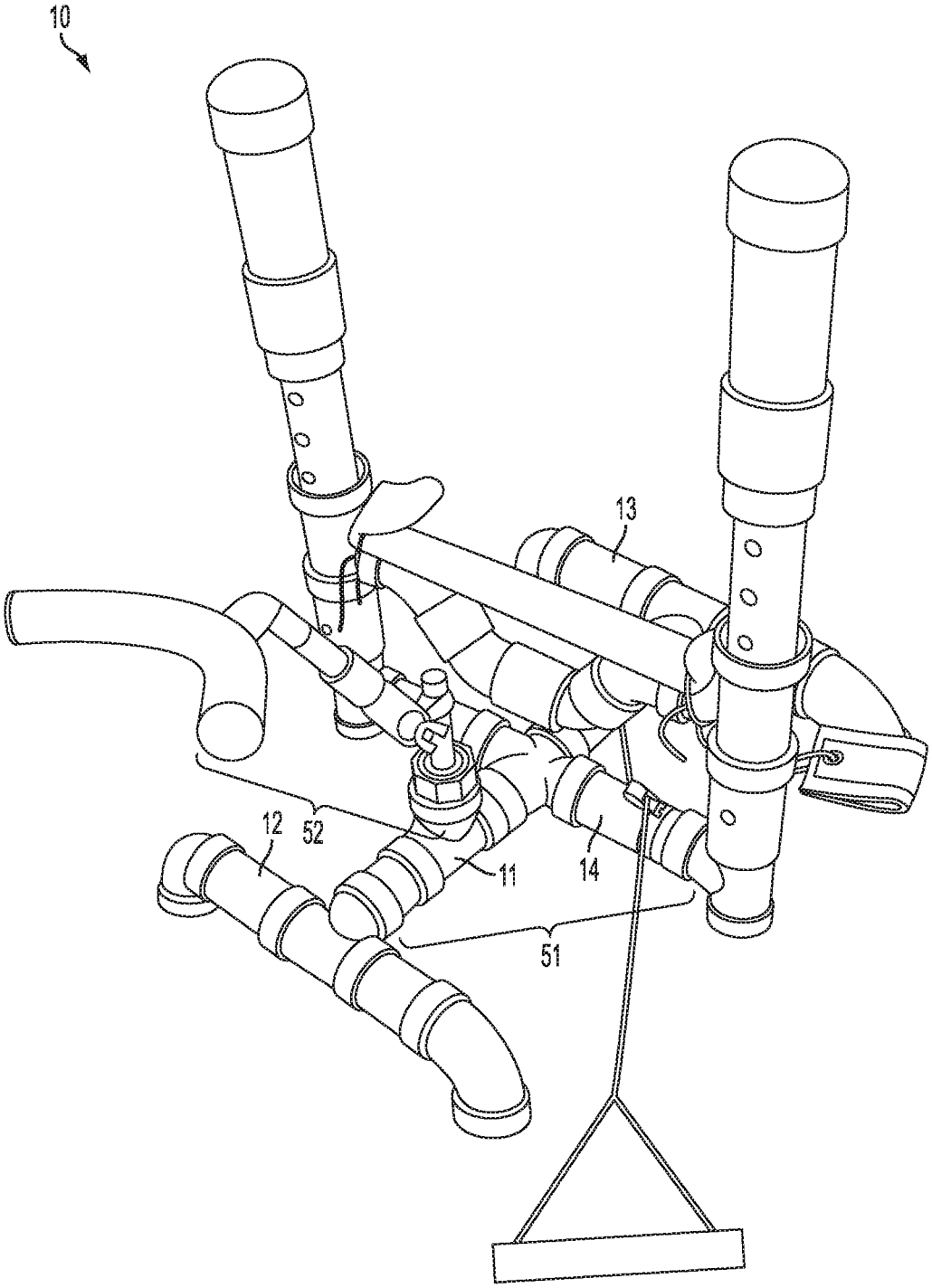
FIG. 1 is a perspective view of an embodiment of the knee rehabilitation assistance device, shown with accessories.

FIG. 1 is a perspective view of an embodiment of knee rehabilitation assistance device 10. Elongated section of pipe 11 forms a central beam. First T section 12 is connected to one end of elongate section of pipe 11, and second T section 13 is connected to the opposite end of elongate section of pipe 11. First T section 12 and second T section 13 form a "T" shape at either end of elongate section of pipe 11, and are approximately parallel to one another. Connected at approximately the center of elongate section of pipe 11 is cross-piece 14. Cross-piece 14 is approximately parallel to first T section 12 and second T section 13. Alternatively to cross-piece 14, two cross members may extend laterally from elongate section of pipe 11 at the location of cross-piece 14. Together, elongate section of pipe 11 and cross-piece 14 combine to form horizontal component 51, which provides a base for knee rehabilitation assistance device 10.

Figure 2:
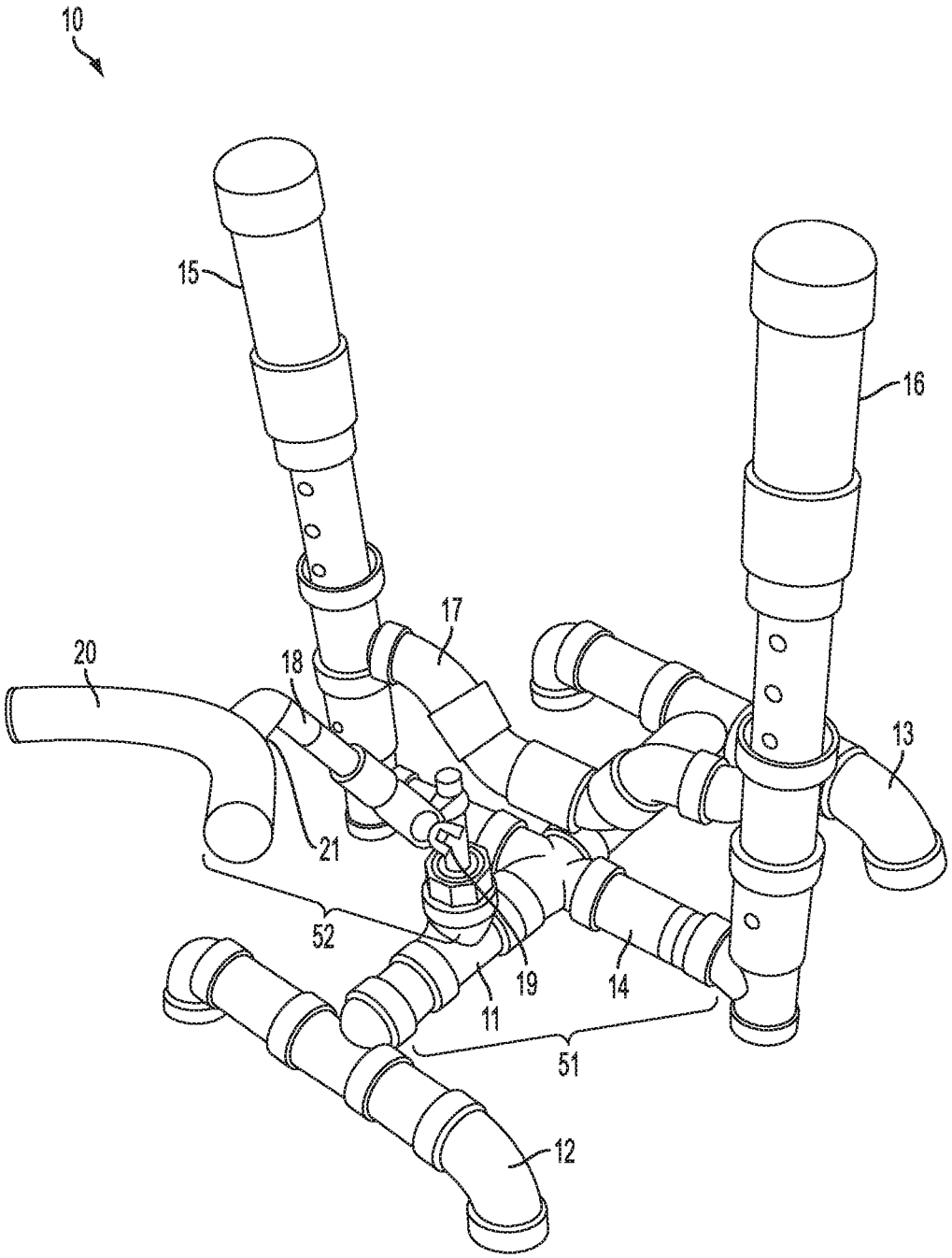
FIG. 2 is a perspective view of an embodiment of the knee rehabilitation assistance device, shown without accessories.

FIG. 2 is another perspective view of an embodiment of knee rehabilitation assistance device 10, showing first vertical section, or riser, 15 attached along one end of cross-piece 14, and second vertical section, or riser, 16 attached along the opposite end of cross-piece 14. First vertical section 15 and second vertical section 16 are approximately parallel to one another, are approximately equal in length to one another, and are approximately perpendicular to cross-piece 14. Stabilizing section 17 attaches to first vertical section 15 and second vertical section 16 to act as a stabilizer and help maintain first vertical section 15 and second vertical section 16 in their approximately parallel positions to one another.

Figure 8:
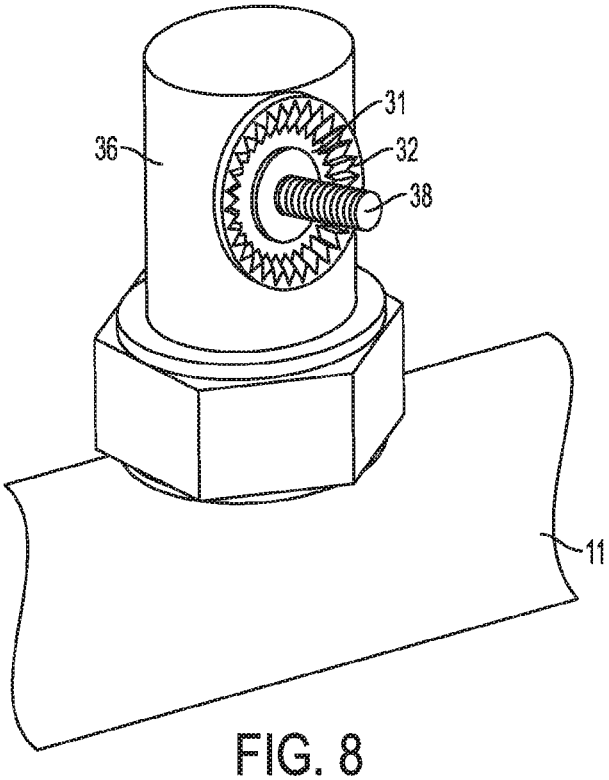
FIG. 8 is a fragmentary perspective view of a portion of the present device, with a mount projecting therefrom.

FIG. 2 also shows elongate leg support bar 18 attached to mount 36. Referring to FIG. 8, in some embodiments, mount 36 vertically projects from a point intermediately along the length of elongate section 11 at a point approximately mid-way between first T section 12 and cross-piece 14. Leg support bar 18 pivotally attaches to mount 36 proximal to the lower end of leg support bar 18. Leg support bar 18 is adjustably rotatable in a clockwise or counterclockwise manner along first axis 19, and is movable along a generally vertical plane from and between a position of approximately zero degrees to approximately 180 degrees in relation to elongate section 11. In some embodiments, leg support bar 18 fits slidably into a leg support bar sleeve (not shown) which may be located intermediately along the length of leg support bar 18. In such embodiments, the length of leg support bar 18 can be adjusted via a telescoping action, to fit to the leg length requirements of the individual user.

Referring again to FIG. 2, brace 20 attaches proximal to the upper end of leg support bar 18 so that brace 20 is distal to elongate section 11. Brace 20 is connected to leg support bar 18 in a manner which forms second axis 21. Brace 20 may be pivotally adjusted upward or downward along second axis 21, as needed to accommodate the comfort requirements of the user. Mount 36, leg support bar 18, and brace 20 combine to form leg positioning element 52 which maintains a user's upper leg, or thigh, in the desired position.

Figure 3:
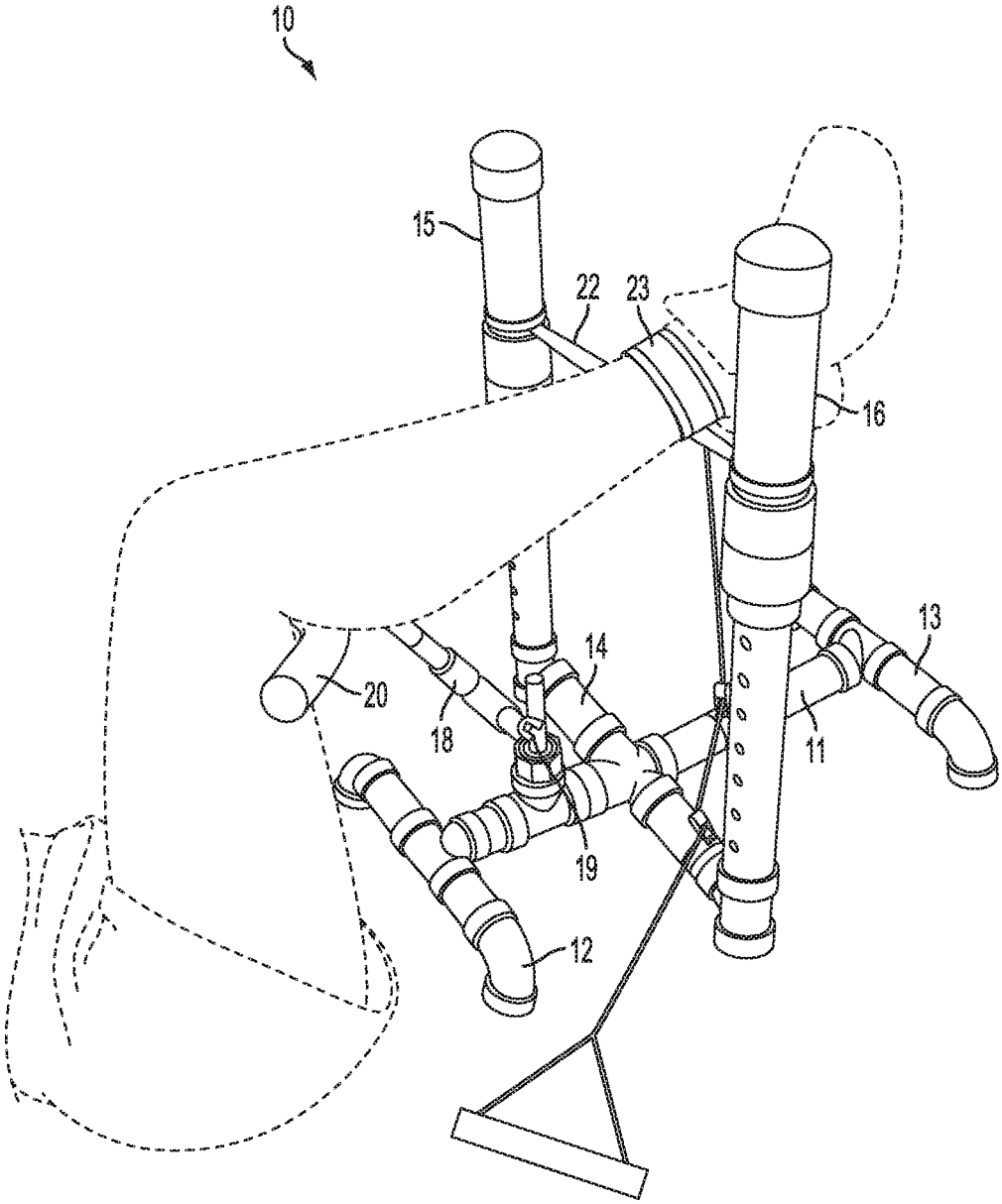
FIG. 3 is a perspective view of an alternative embodiment of the device, showing a user's leg positioned for using the device.

In FIG. 3, a user is positioned to use knee rehabilitation assistance device 10. The back of the user's upper thigh is positioned in the concavity of brace 20. To better enable the user's leg to move through its fullest possible range of motion, the user should position his or her leg against brace 20 in proximity to but above the knee, so that brace 20 rests against the bottom of the user's leg biceps. In the embodiment shown in FIG. 3, the back of the user's lower leg rests against elastic band 22. One end of band 22 is tethered to first vertical section 15, and the other end of band 22 is tethered to second vertical section 16. The ends of band 22 may be tethered along the length of first and second vertical sections 15, 16 to span the distance between first and second vertical sections 15, 16 along a generally horizontal plane, at a selected height which may be chosen by the user according to the desired range within which the user desires to limit his or her leg flexion.

Figure 4:
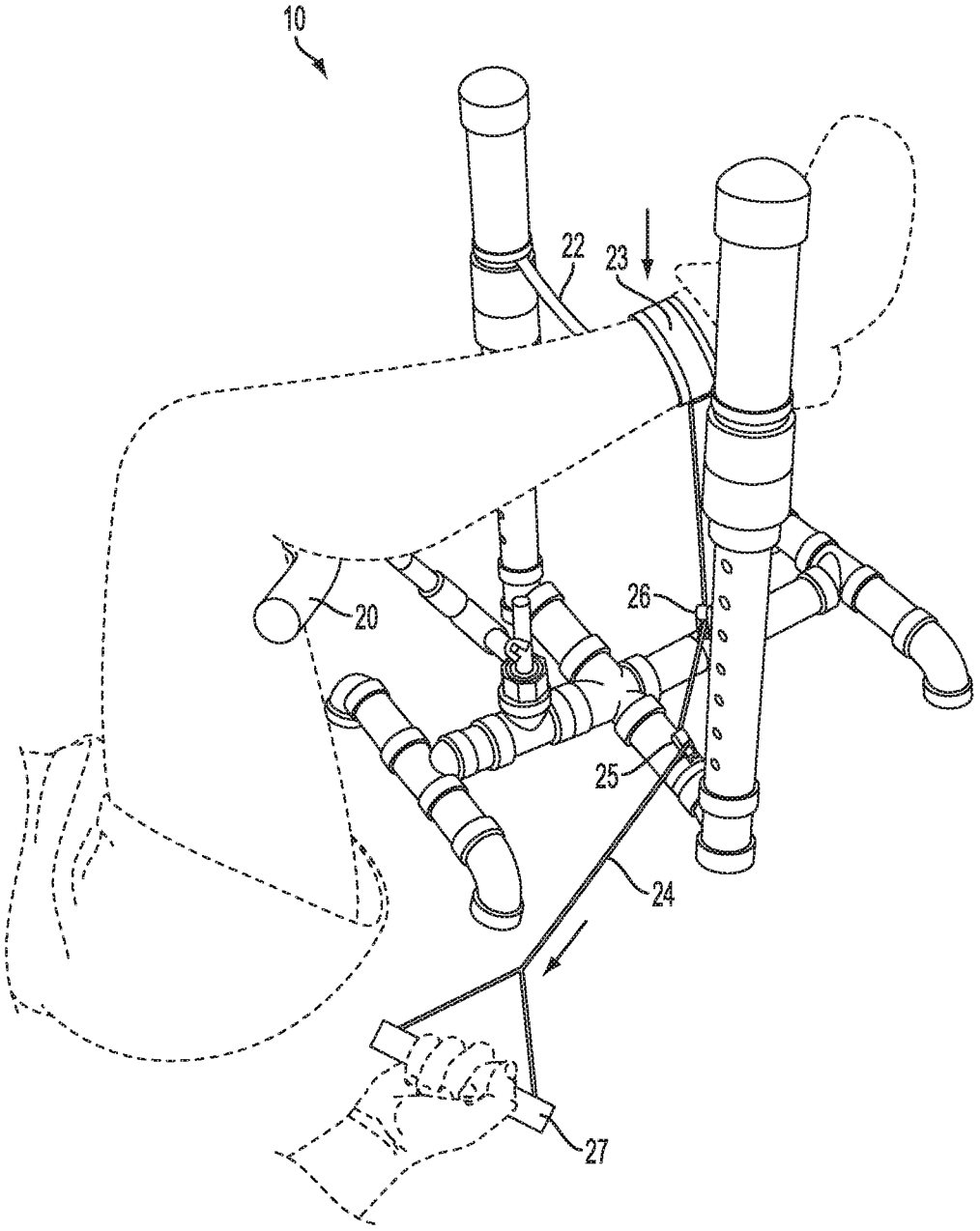
FIG. 4 is a perspective view of the device shown in FIG. 3, showing a user going through manually assisted leg flexion.

FIG. 4 shows a user employing the device for manually-assisted range-of-motion exercise. A manual exerciser attaches to the user's lower leg at one end and it's other end reaches to a location where the user may grasp the manual exerciser. The embodiment in FIG. 4 shows ankle strap 23 secured to the user's ankle. Rope 24 comprised of nylon or other weather-resistant material has handle 27 attached proximal to one of its ends. Ankle strap 23 is attached proximal to the end of rope 24 opposite that to which handle 27 attaches, and is secured to the user's ankle. FIG. 4 shows the user grasping handle 27 and exerting a pulling force along a generally horizontal plane. Pulling on handle 27 creates tension in rope 24. First pulley 26 guides rope 24 to exert a reciprocal downward pulling force on the user's lower leg, so that the heel of the user's foot moves along a generally vertical plane toward the user's buttocks. The greater the pulling force exerted on handle 27, the greater the reciprocal pulling force upon the user's lower leg. Second pulley 25 is shown attached intermediately along the length of cross-piece 14 to accommodate a user employing his or her right hand to grip and pull on handle 27.

Figure 5:
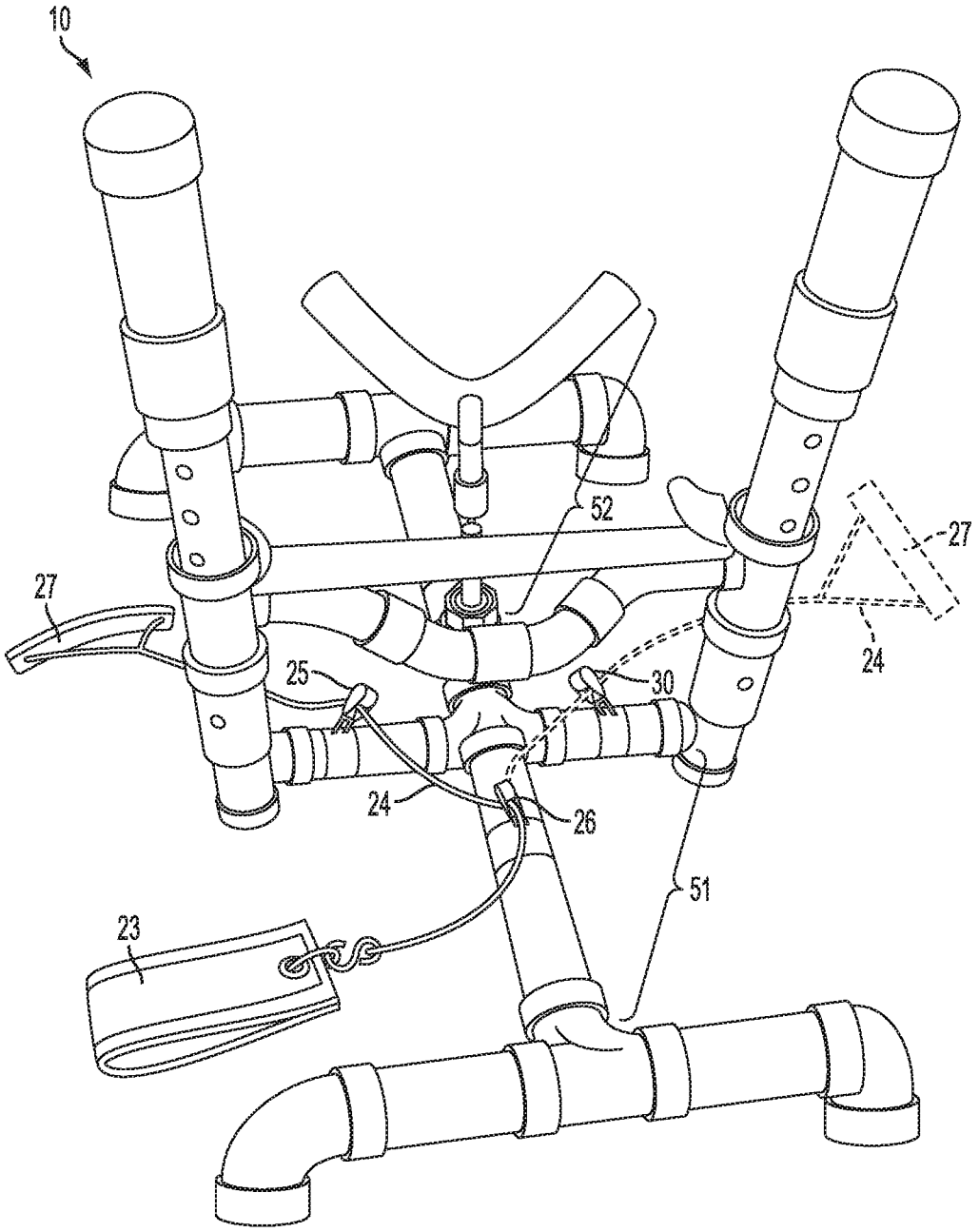
FIG. 5 is a back perspective view of the device shown in FIG. 1.

FIG. 5 is a perspective view of an embodiment of knee rehabilitation assistance device 10, with the back of the device in the foreground. As shown in FIG. 5, second pulley 25 may be repositioned to attach along alternate second pulley location 30, to accommodate use of the user's left hand to grip and pull handle 27. FIG. 5 also provides a rear view of elongate section of pipe 11 and cross-piece 14 combining to form horizontal component 51 and provide a base for knee rehabilitation assistance device 10 (and see FIG. 7).

Figure 6:
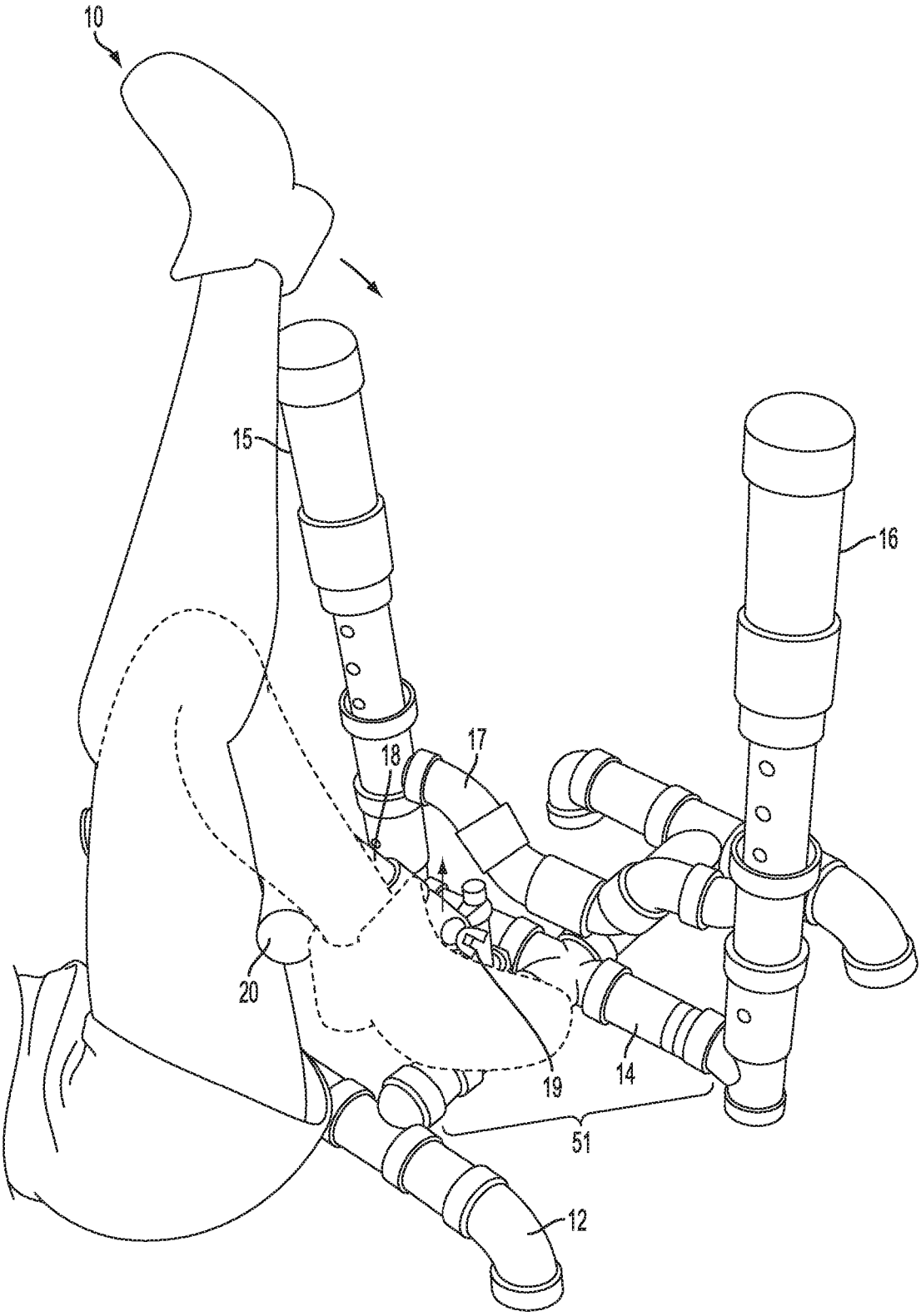
FIG. 6 is a perspective view of the embodiment shown in FIG. 2, showing a user going through active range-of-motion exercise.

The embodiment shown in FIG. 6 is a perspective view of the embodiment shown in FIG. 2. In FIG. 6, the user is undertaking active range-of-motion exercise by extending and flexing his or her leg, with the back of the user's upper thigh positioned against brace 20. The user is shown moving his or her lower leg from a position approximating full leg extension, to a position approximating full flexion. The user may choose to use ankle weights if he or she desires, to add strength-building resistance to the exercise. Referring again to FIG. 4, the user may also undertake strength-building exercise by attaching ankle strap 23 to his or her ankle, and exerting tension on leash 24 by pulling on handle 27.

Figure 7:
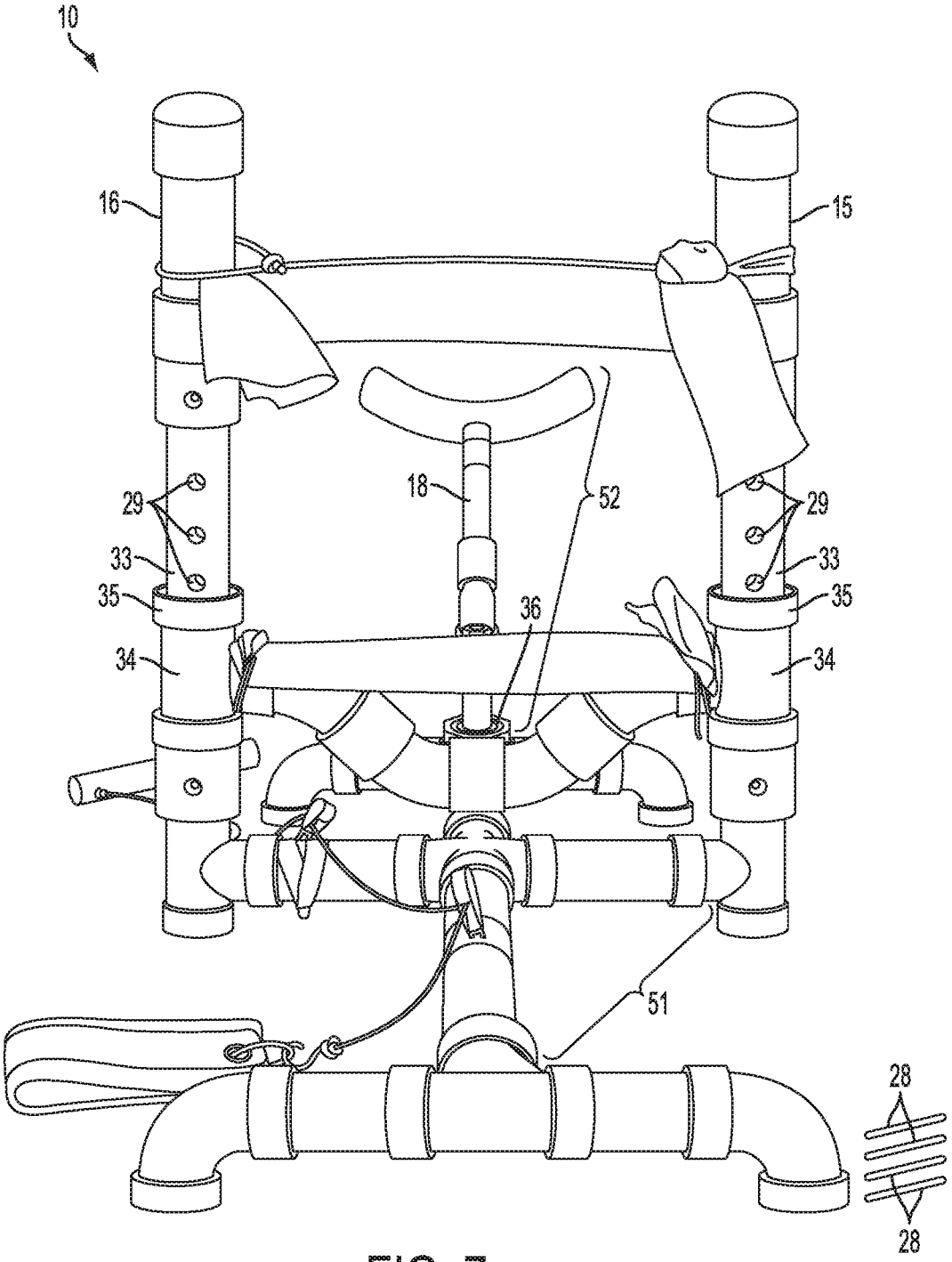
FIG. 7 is a front perspective view of the device shown in FIG. 3.

FIG. 7 is a perspective view of an embodiment of knee rehabilitation assistance device 10, with the back of device 10 shown at the forefront. First vertical section 15 and second vertical section 16 are each comprised of inner slide cylinder 33 and outer sleeve 34. Inner slide cylinder 33 fits into outer sleeve 34, and can be easily manipulated to telescopically slide in and out of outer sleeve 34.

Both first vertical section 15 and second vertical section 16 each have a plurality of apertures 29 drilled through them. After first vertical section 15 and second vertical section 16 are telescopically adjusted to a desired length, pin 28 fits into aperture 29 which is nearest to mouth 35 of outer sleeve 34 of first vertical section 15 and second vertical section 16. Pin 28 catches flush against mouth 35 of outer sleeve 34 to maintain first vertical section 15 and second vertical section 16 at a selected height. Band 22 is shown tethered to and spanning the distance between first and second vertical sections 15, 16, along a generally horizontal plane. By telescopically adjusting the lengths of first and second vertical sections 15, 16, band 22 may be positioned at a selected height in accordance with the range within which the user wishes the band 22 to limit the degree of leg flexion. This feature may be useful in situations where, for example, the user is at a rehabilitation stage where pain or stiffness makes it desirable to limit the range of leg flexion.

FIG. 8 is a fragmentary perspective view of a portion of elongate section 11. Mount 36 is shown projecting vertically from a position intermediately along the length of elongate section 11. Mount 36 has annular socket 31 comprised of a plurality of tapered, equally-spaced first teeth 32 situated circumferentially along socket 31.

Figure 9:
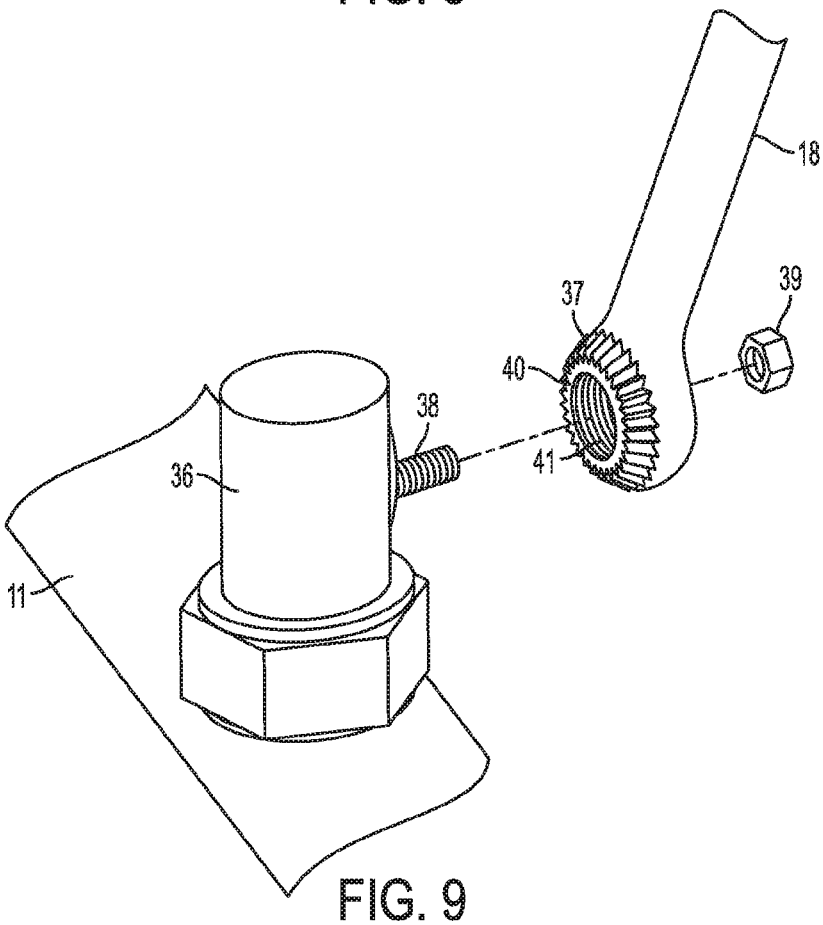
FIG. 9 is a fragmentary perspective view of a portion of the present device.

FIG. 9 is a fragmentary perspective view of a portion of the present device. Proximal to the lower end of elongate leg support bar 18 is an annular spline 40 comprised of a plurality of tapered, equally-spaced second teeth 37 situated circumferentially along spline 40. Second teeth 37 are complimentarily sized, configured, and positioned to interlockably engage with first teeth 32. Fastening components are used to releasably couple said first teeth 32 and said second teeth 37 to allow leg support bar 18 to adjustably rotate along a vertical plane. Fastening components are comprised of an elongate first bolt 38 having external, spiral threads. First bolt 38 projects radially from socket 31, and is configured to fit through a similarly-sized aperture 41 traversing radially of spline 40. A first nut 39 having a spiral-threaded inner circumference fastens to first bolt 38 to adjustably fasten leg support bar 18 to mount 36 at a selected angle.

Figure 10:
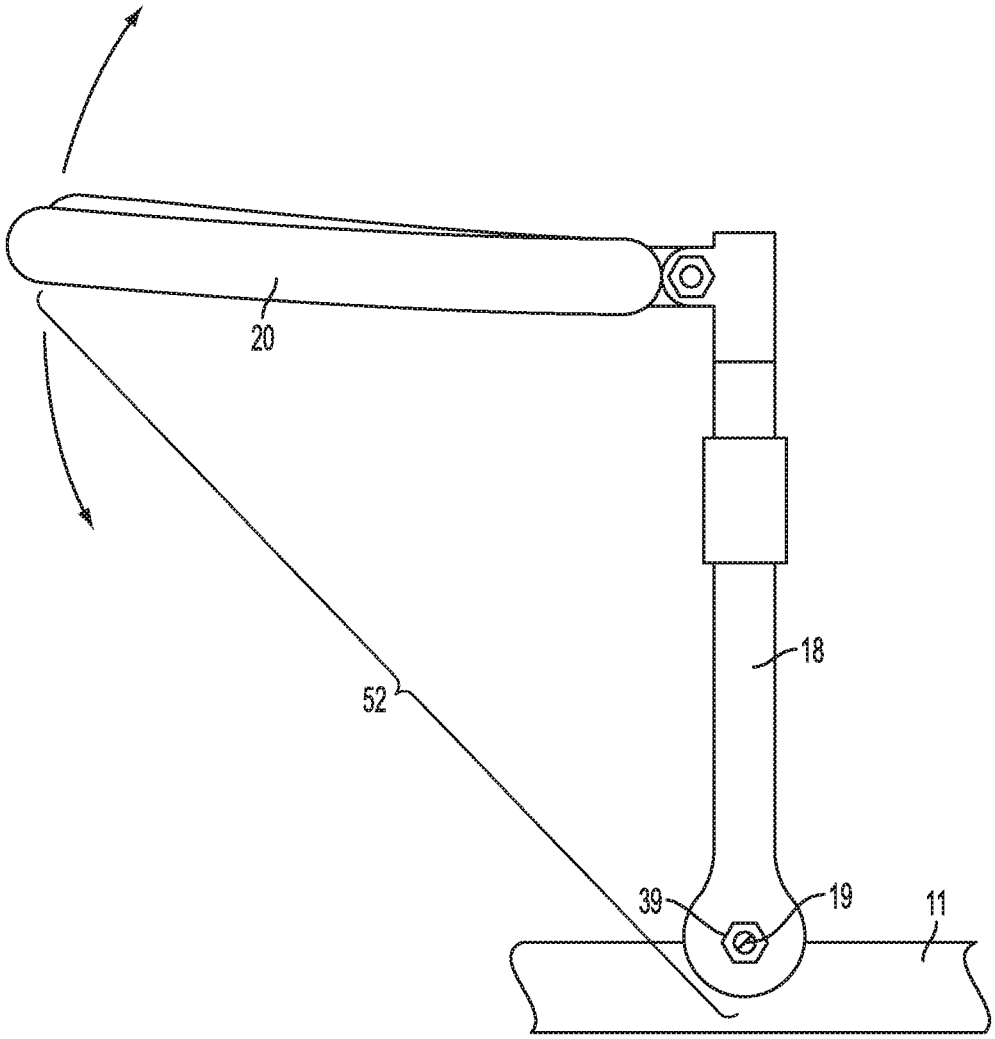
FIG. 10 is a fragmentary side view of a portion of the present device.

FIG. 10 is a fragmentary side view of a portion of the present device. First axis 19 along which support bar 18 adjustably rotates is generally parallel to the pivot axis of the user's knee joint, so that leg support bar 18 is rotatable clockwise and counterclockwise along a generally vertical plane. The specific manner in which mount 36 attaches proximal to the lower end of leg support bar 18 is not critical so long as leg support bar 18 may be firmly, rotatably secured at a selected angle. Leg support bar 18 and brace 20 are components of leg positioning element 52. Brace 20 can also be angularly adjusted and secured at a selected angle with respect to leg support bar 18.

Figure 11:
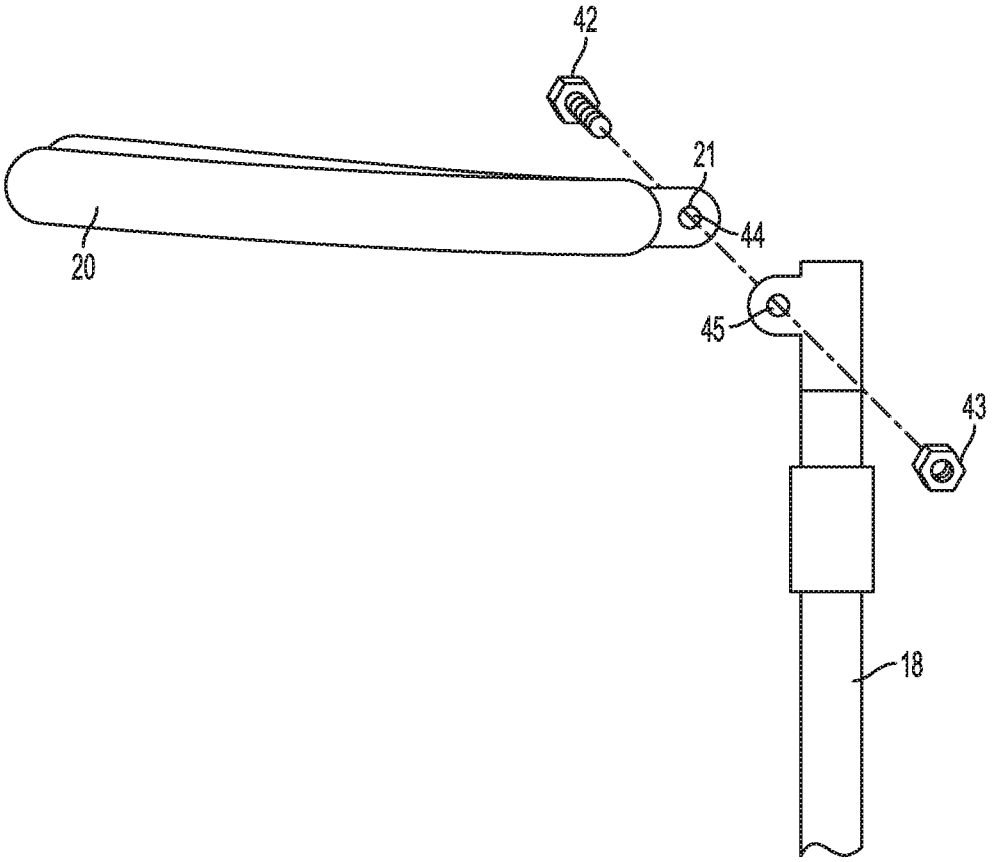
FIG. 11 is an exploded fragmentary side view of some components of the present device.

FIG. 11 is an exploded fragmentary side view of a portion of the present device. A portion of the upper end of support bar 18 is shown. A smooth, arcuate brace 20 pivotally mounts proximal to the upper end of support bar 18. In an embodiment, brace 20 has a first yoke located along its apex, said first yoke having first yoke aperture 44. The upper end of support bar 18 has a second yoke including a second yoke aperture 45 of similar size to that of first aperture 44. An externally-threaded elongate second bolt 42 bolt fits through both apertures. A second nut 43 having threads along an inner circumference fastens to second bolt 42, to engage brace with upper end at a selected angle. Second nut 43 can be loosened from second bolt 42 to allow brace 20 to selectively pivot upward or downward along a vertical plane, to a position suitable to the user's comfort requirements.

The specific manner in which brace 20 is secured proximal to the upper end of support bar 18 is not critical so long as brace 20 may be firmly, pivotally secured at a selected angle. As the user lies supine on a flat surface in position to use the device, the open end of brace 20 faces toward the user. The back of the upper thigh of the leg being rehabilitated by said user fits into the concavity of brace 20, and with brace 20 proximal to the knee joint at a location just above the crease of the knee joint. Thus, the user's upper thigh is maintained at a selected vertical angle, thereby enabling the lower leg to be selectively raised and lowered relative to said upper thigh. To optimize range of motion and minimize knee joint swelling, the selected angle of the user's upper thigh may be approximately ninety degrees relative to the horizontal surface upon which the user is lying during exercise.

It is to be understood that the embodiments and claims herein are not limited in application to the details of construction and arrangement of the components set forth in the description and illustrated in the drawings. Rather, the description and the drawings provide examples of the embodiments envisioned, but the claims are not limited to any particular embodiment or a preferred embodiment disclosed and/or identified in the specification. The drawing figures are for illustrative purposes only, and merely provide practical examples of the invention disclosed herein. Therefore, the drawing figures should not be viewed as restricting the scope of the claims to what is depicted.

The embodiments and claims herein are further capable of other embodiments and of being practiced and carried out in various ways, including various combinations and sub-combinations of the features described above but that may not have been explicitly disclosed in specific combinations and sub-combinations. Accordingly, those skilled in the art will appreciate that the conception upon which the embodiments and claims are based may be readily utilized as a basis for the design of other structures, methods, and systems. In addition, it is to be understood that the phraseology and terminology employed herein are for the purposes of description and should not be regarded as limiting the claims.

I claim:

1. A knee rehabilitation assistance device for utilization by a user lying on his or her back on a horizontal surface, the device comprising:

a frame having:

a horizontal component;

two vertical components, each having two ends;

a stabilizer having two ends;

a cross-piece; and an elongate section having a proximal end configured to be near the user during use and a distal end configured to be away from the user during use, wherein the horizontal component is in contact with the surface upon which the user is lying, wherein the cross-piece intersects the elongate section between the proximal and distal ends of the elongate section and near the center of the cross-piece, wherein the vertical components are located on opposite sides of the elongate section and join the cross-piece near the first ends of the two vertical components, and wherein each end of the stabilizer joining a respective vertical component between the cross-piece and the second end of the vertical component;

a leg-positioning element having:

a mount located on the elongate section of the frame between the proximal end of the elongate section and the cross-piece;

a leg brace with two ends, and a leg support bar inclining upward in the direction of the proximal end of the elongate section, with an upper end attached to the leg brace and a lower end attached to the mount;

wherein the leg support bar joins the leg brace between the two ends of the leg brace, wherein the leg brace is configured to contact the back of the user's thigh, and wherein the leg-positioning element is configured to maintain the user's thigh at a chosen angle; and a flexion-and-extension assistor having:

a handle;

an ankle strap; and a connector between the handle and the ankle strap, wherein the flexion-and-extension assistor is configured for manual operation.

2. The device of claim 1, wherein the horizontal component comprises two T sections aligned parallel to one another and perpendicular to the elongate section, each T section having a length and two ends, wherein the proximal end of the elongate section is operably connected near the center of the length of one T section, and wherein the distal end of the elongate section is operably connected near the center of the length of the other T section.

3. The device of claim 1, wherein the lower end of the leg support bar is pivotally connected to the mount and the incline of the leg support bar is adjustable at the mount, wherein the upper end of the leg support bar is pivotally attached to the leg brace, and wherein the leg brace has an arcuate portion such that the back of the upper thigh of the user fits within the arcuate portion of the leg brace.

4. The device of claim 1, wherein the connector of the flexion-and-extension assistor comprises a rope.

5. The device of claim 4, further comprising a first pulley attached to the elongate section between the proximal and distal ends of the elongate section, wherein the rope is wrapped, at least partially, around the first pulley.

6. The device of claim 5, wherein the ankle strap is configured to wrap around the user's ankle such that the user may grasp the handle with one hand and manually pull the handle to move the user's lower leg, and wherein the first pulley is configured to guide the rope to reciprocally move the user's lower leg vertically.

7. The device of claim 5, further comprising a second pulley relocatably attached to the cross-piece, wherein the rope is wrapped, at least partially, around the second pulley.

8. The device of claim 1, further comprising an elastomeric band having two ends, wherein each of the ends of the elastomeric band is tethered to a vertical component between the cross-piece and the second end of the vertical components, wherein the elastomeric band is partially taut, and partially horizontal, and the band is configured to be selectively tetherable at different heights above the horizontal surface such that the user can control the degree of flexion at which the band contacts the lower leg during exercise.

9. A knee rehabilitation assistance device for utilization by a user lying on his or her back on a horizontal surface, the device comprising:

a frame comprising:

a base contacting the horizontal surface, the base comprising:

a central beam having a distal end away from the user and a proximal end near to the user;

a first cross member extending laterally from the central beam between the distal end and the proximal end; and a second cross member extending laterally from the central beam opposite the first cross member and between the distal end and the proximal end;

two risers, each having a bottom end and a top end, wherein the first cross member is joined to one riser near the bottom end and extends upward, and wherein the second cross member is joined to the other riser near the bottom end and extends upward; and a stabilizer having two ends, wherein the ends of the stabilizer are each joined to one of the risers above the attached cross member;

a leg support bar having a base end and an elevated end, wherein the base end is joined to the central beam between the proximal end and the first and second cross members, wherein the leg support bar inclines from the base end up and above the proximal end, toward the user when in use;

a brace having a length and two ends, wherein the elevated end of the leg support bar is joined to the brace between the two ends of the brace;

a band having two ends, wherein the ends of the band are each joined to one of the risers above the stabilizer; and a manually actuated exerciser having a connecting end and a handle end with a connecting band connected to the connecting end, wherein the brace and leg support bar are configured to brace against the underside of the user's thigh during use to maintain the thigh at a selected elevated angle, and wherein the connecting band is configured to wrap around the user's lower leg.

10. The knee rehabilitation assistance device of claim 9, wherein each riser comprises an outer sleeve and an inner shaft slidably located within the outer sleeve, wherein each inner shaft has a series of apertures along its length such that a pin placed in one of the apertures maintains the position of the inner shaft within outer sleeve such that the length of the riser is adjustable.

11. The knee rehabilitation assistance device of claim 9, further comprising a mount on the central beam between the proximal end and the first and second cross members, wherein the mount is pivotable about a vertical axis, wherein the base end of the leg support bar is joined to the mount, and wherein the leg support bar is pivotable with respect to the mount about a horizontal axis.

12. The knee rehabilitation assistance device of claim 9, further comprising a pulley attached to the central beam, wherein the manually actuated exerciser comprises a rope between the connecting end and the handle end, and wherein the rope wraps at least partially around the pulley.

13. The knee rehabilitation assistance device of claim 12, further comprising a second pulley attached to one of the cross members, wherein the rope wraps at least partially around the second pulley.

14. The knee rehabilitation assistance device of claim 9, further comprising two T sections aligned horizontally and perpendicular to the central beam, each T section having two ends, wherein the proximal end of the central beam joins one T section between the two ends of the T section, and wherein the distal end of the central beam joins the other T section between the two ends of the T section.

* * * * *